US007735429B2

(12) United States Patent
Meissen

(10) Patent No.: US 7,735,429 B2
(45) Date of Patent: Jun. 15, 2010

(54) CONNECTOR FOR SUPPORT STRUCTURES

(75) Inventor: Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1288 days.

(21) Appl. No.: 10/963,951

(22) Filed: Oct. 12, 2004

(65) Prior Publication Data

US 2006/0075938 A1 Apr. 13, 2006

(51) Int. Cl.
*B65D 19/38* (2006.01)

(52) U.S. Cl. ..... 108/54.1; 108/64

(58) Field of Classification Search ..... 108/64, 108/54.1, 56.1, 56.3, 51.11; 706/504; 748/346.07; 312/111; 446/124, 125, 126, 117, 103, 166; 249/119

See application file for complete search history.

(56) References Cited

U.S. PATENT DOCUMENTS 2,739,776 A * 3/1956 Terando ..... 108/54.1
2,861,388 A * 11/1958 Favaretto ..... 446/124
3,208,606 A * 9/1965 Epstein et al. ..... 108/54.1
3,342,146 A * 9/1967 Lessheim ..... 108/53.3
3,528,192 A * 9/1970 Meates ..... 446/124
3,650,224 A * 3/1972 Petix et al. ..... 108/54.1
3,987,579 A * 10/1976 Palenik, III ..... 446/124
4,694,962 A * 9/1987 Taub ..... 108/54.1
4,895,080 A * 1/1990 Thomas ..... 108/56.1
D310,481 S * 9/1990 Chanel ..... D9/757
5,105,746 A * 4/1992 Reynolds ..... 108/56.1
5,179,800 A * 1/1993 Huang ..... 47/73
5,267,516 A * 12/1993 Abrahamson et al. ..... 108/54.1
5,388,533 A * 2/1995 Pigott et al. ..... 108/56.3
5,400,719 A * 3/1995 Santapa et al. ..... 108/64
5,460,561 A * 10/1995 Dahlgren ..... 446/117
5,492,069 A * 2/1996 Alexander et al. ..... 108/56.3
5,528,996 A * 6/1996 Edwards et al. ..... 108/64
5,586,666 A * 12/1996 Squitieri ..... 108/54.1
D384,995 S * 10/1997 Munir ..... D21/491
5,794,543 A * 8/1998 John et al. ..... 108/56.1
5,794,545 A * 8/1998 McDaniel et al. ..... 108/64
5,842,425 A * 12/1998 van der Aa ..... 108/64
5,860,369 A * 1/1999 John et al. ..... 108/56.1
6,119,426 A * 9/2000 Escudero ..... 446/124
6,231,910 B1 * 5/2001 Ellingsworth ..... 426/505
6,234,087 B1 * 5/2001 Brown ..... 108/56.1
6,793,193 B2 * 9/2004 de Groote ..... 249/119
D557,874 S * 12/2007 Dong et al. ..... D34/38

* cited by examiner

*Primary Examiner*—José V Chen
(74) *Attorney, Agent, or Firm*—Carlson, Gaskey & Olds

(57) ABSTRACT

A connector selectively connects at least two support structures to provide a larger, rigid support structure. The connector includes a body portion from which extends downward a center support portion. A pair of outer sleeves extend downwardly from the body portion on opposite sides of the center support portion, each outer sleeve extending downwardly less than the center support portion. In use, the outer sleeves are inserted through openings in the support structures into the feet of the support structures. The body portion rests on the decks of the support structures and the center support portion extend downward from the body portion between the support structures. The center support portion is sized to extend to the floor when the connector is connected to the support structures.

9 Claims, 16 Drawing Sheets

10
10
10
10
20
20
20
20
20
20
14
14
14

SECTION A-A
A
10
12
14
16
18
20
22
24
26
28

44
44
44

40
44
44
44
44
40
40
40

CONNECTOR FOR SUPPORT STRUCTURES

BACKGROUND OF THE INVENTION

The present invention relates generally to support structures and more particularly to a connector for connecting two support structures, such as pallets, to form a single, large support structure.

Pallets are often used to store and transport goods. Pallets maintain the goods at a distance above the floor such that they can readily be lifted and moved by a forklift. Plastic pallets are lighter and more durable than wooden pallets. Elongated metal or composite reinforcement members have been used in some plastic pallets in order to increase the stiffness and load-bearing capacity of the pallet.

Some plastic pallets are nestable. The nestable pallets generally include openings in the deck that are aligned with recesses in the feet, such that feet of one deck may receive the feet of another, like pallet stacked thereon. Nestable pallets reduce the overall size of the stacked pallets when empty for convenient transport and storage.

Pallets are typically provided in one of several standard sizes. Occasionally, it is desirable to use pallets for an object (such as a bundle of goods) that are greater than the size of the pallet, even greater than two or three times the size of the pallet. Two or more standard size pallets can be used adjacent one another if the object is rigid and self-supporting, but not if the object is non-rigid and needs a continuous rigid support structure.

SUMMARY OF THE INVENTION

The present invention provides a connector for connecting at least two support structures to provide a larger, rigid support structure. The connector includes a body portion from which extends downward a center support portion. A pair of outer sleeves extend downwardly from the body portion on opposite sides of the center support portion, each outer sleeve extending downwardly less than the center support portion. In several embodiments, the body portion is a single elongated body portion, x-shaped, a circumscribed x-shape, or planar.

In use, the outer sleeves are sleeved through openings in the support structures into the feet of the support structures. The body portion rests on the decks of the support structures and the center support portion extend downward from the body portion between the support structures. The center support portion is sized to extend to the floor when the connector is connected to the support structures.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
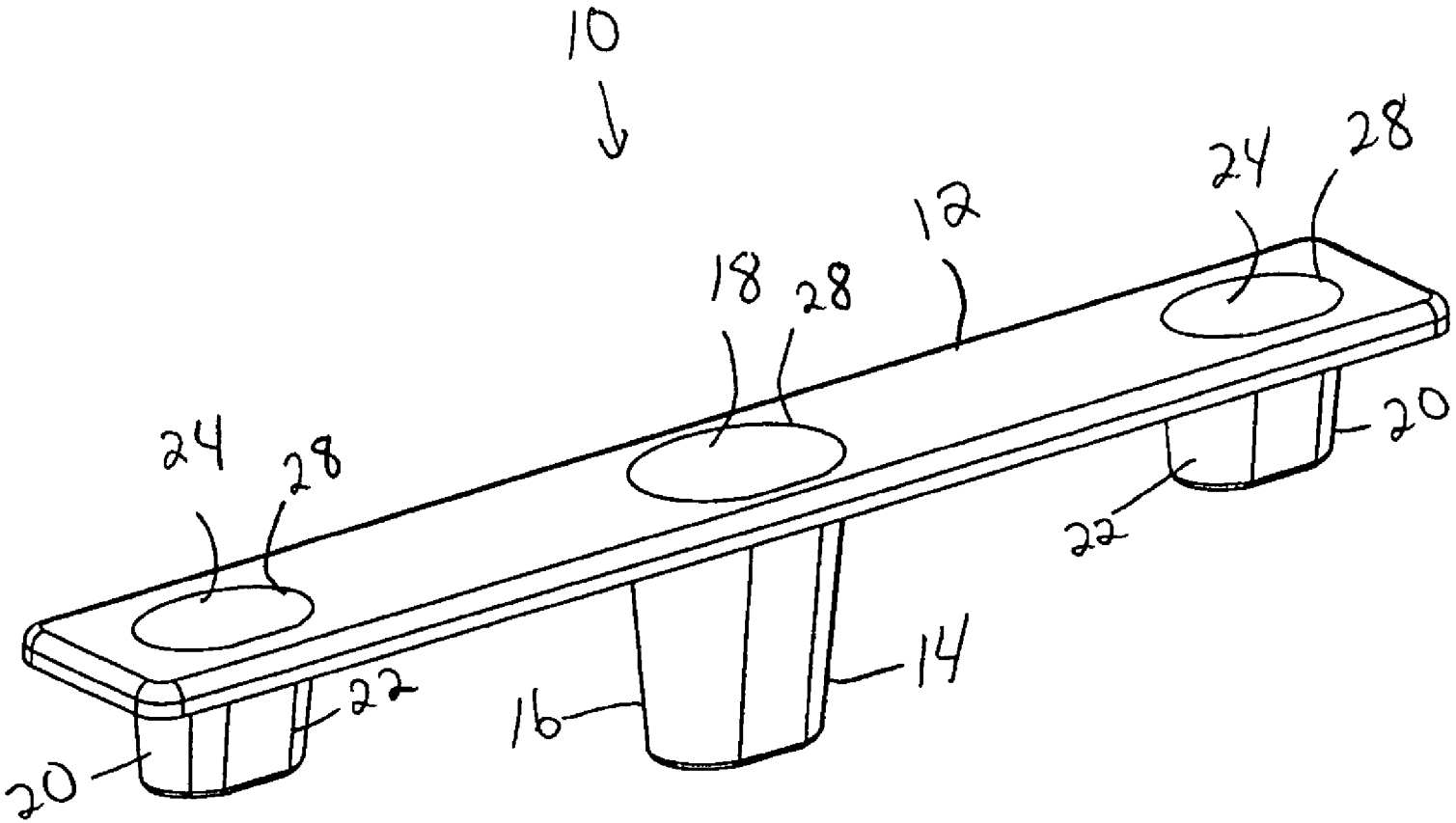
FIG. 1 is a perspective view of a connector according to a first embodiment of the present invention.

Referring to FIG. 1, a connector 10 according to a first embodiment of the present invention includes an elongated body portion 12 and a center support portion 14. The center support portion 14 has a generally cylindrical wall 16 extending downward from the center of the body portion 12 to form a foot portion. The wall 16 defines a center recess 18 therein.

A pair of outer sleeves 20 on either side of the center support portion 14 and at opposite ends of the body portion 12 each include a generally cylindrical wall 22. The walls 22 each define an outer recess 24 therein. An opening 28 through the body portion 12 is aligned with each of the outer recesses 24 and the center recess 18. The connector 10 is nestable with similar connectors 10, such that the outer sleeves 20 and center support portion 14 can be received within the outer sleeves 20 and center support portion 14 of a like connector 10 stacked therebelow.

Figure 2:
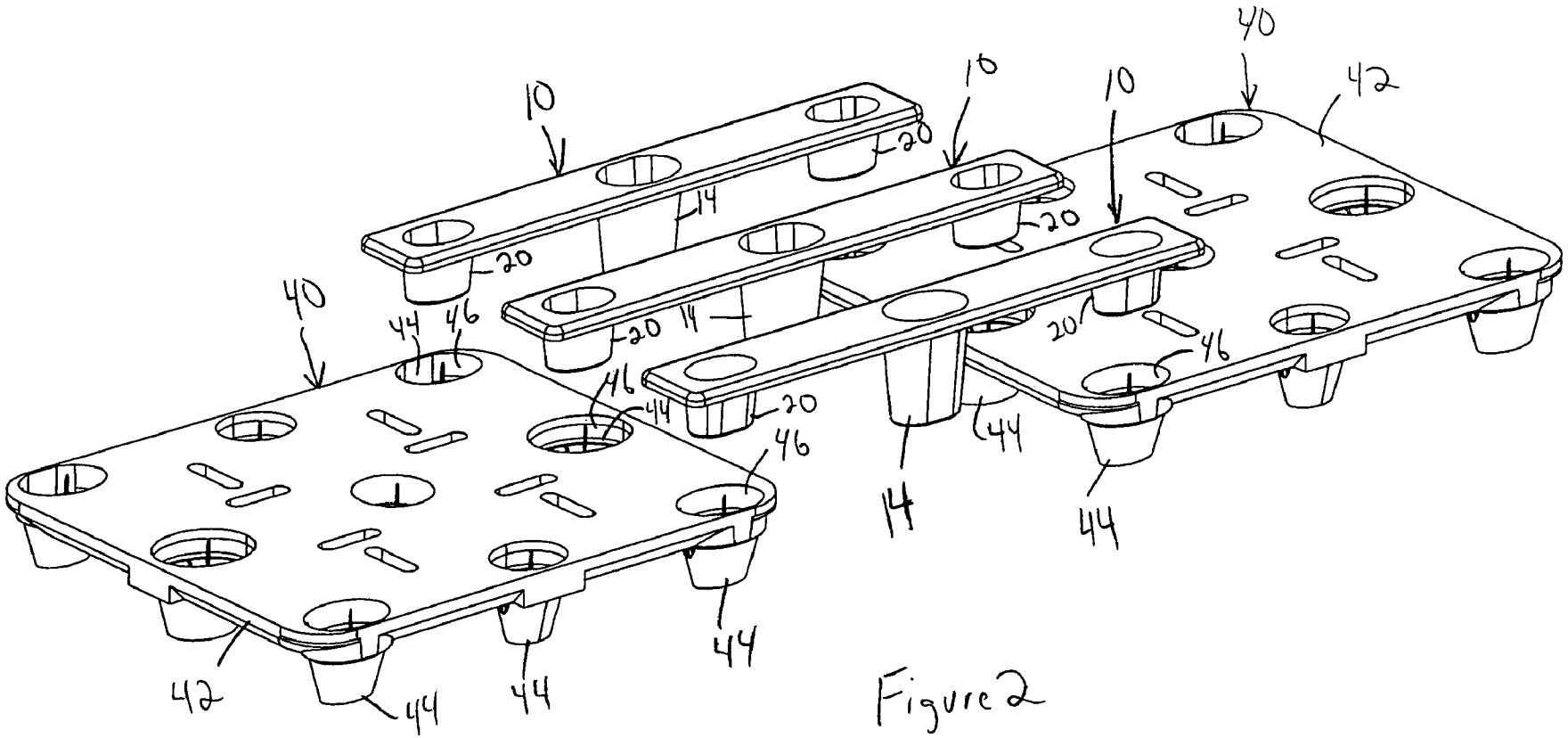
FIG. 2 is a perspective view of three of the connectors of FIG. 1 and two support structures.

FIG. 2 illustrates three of the connectors 10 connecting two support structures 40. In the example shown, the support structures 40 are nestable pallets having a deck 42 and generally cylindrical feet 44 extending downward therefrom. Openings 46 in the deck 42 are aligned with the feet 44. The openings 46 are capable of receiving therein the feet 44 of a like pallet 40, such that the pallets 40 are nestable.

Figure 3:
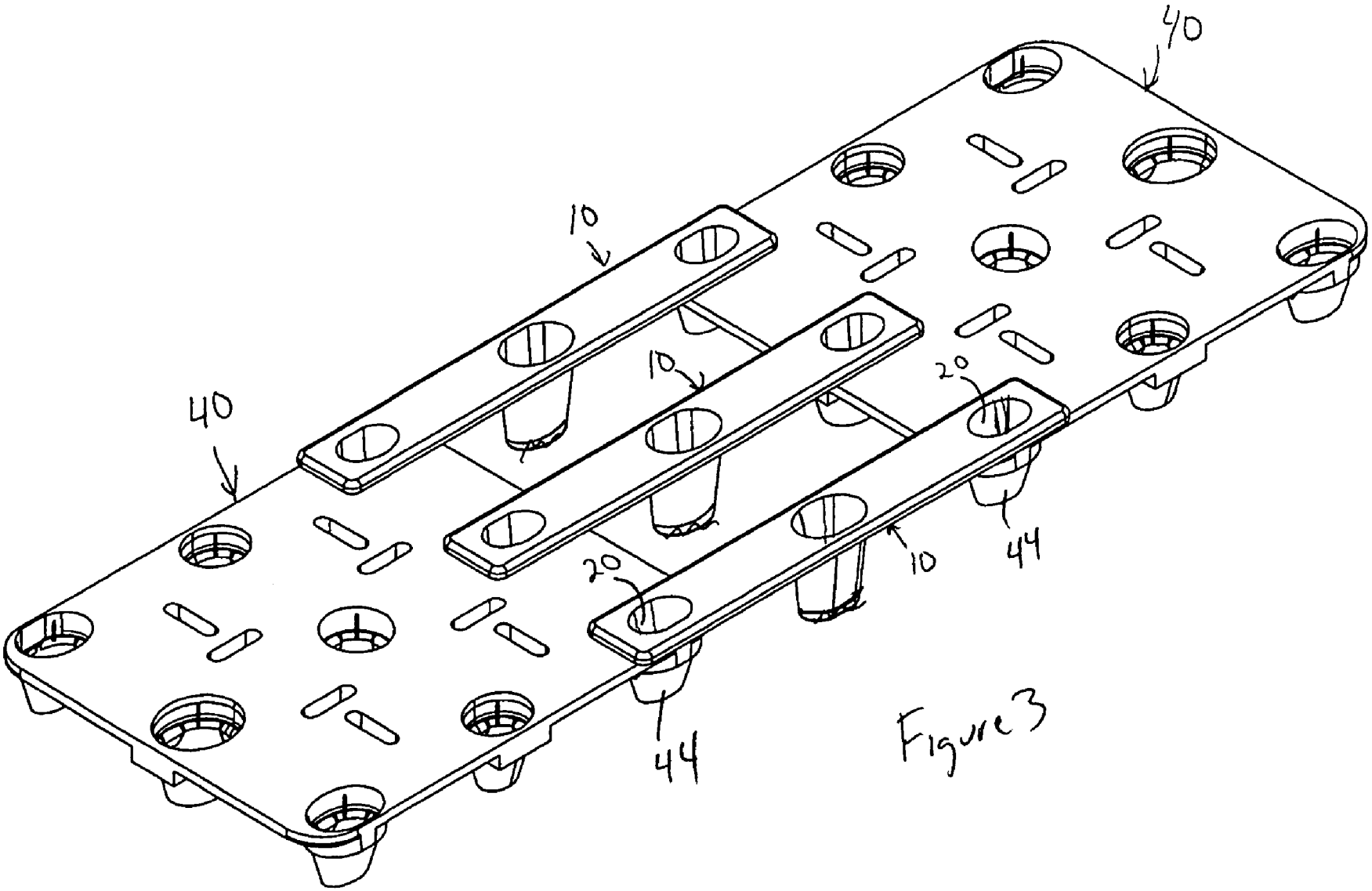
FIG. 3 is a perspective view of the connectors connecting the support structures of FIG. 2.
Figures 4, 5, 6:
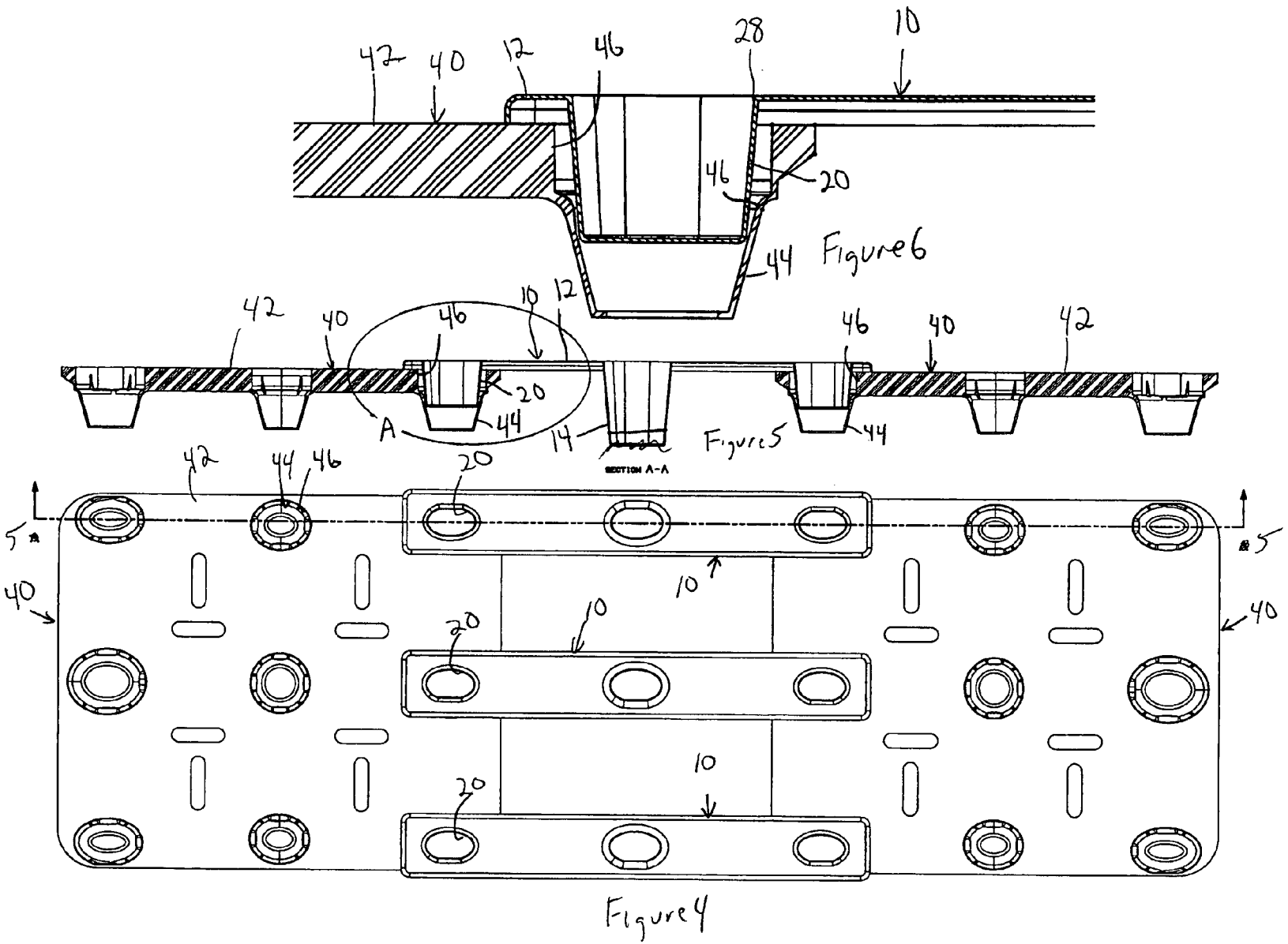
FIG. 4 is a top view of the connectors and support structures of FIG. 3.
FIG. 5 is a sectional view taken along line 5-5 of FIG. 4.
FIG. 6 is an enlarged view of Area A of FIG. 5.

To connect the two support structures 40, the outer sleeves 20 of the connectors 10 are aligned with adjacent openings 46 along one peripheral edge of each support structure 40. The outer sleeves 20 are then sleeveed into the openings 46 and into the feet 44 of the support structures 40, as shown in FIGS. 3 and 4. The two structures 40 and connectors 10 provide a single, large, rigid support for supporting objects, such as large, non-rigid objects.

FIG. 5 is a section view along lines 5-5 of FIG. 4. As shown in FIG. 5, the outer sleeves 20 are received within the feet 44 of the support structures 40. When the connectors 10 are connected to the support structures 40, the bottom-most edge of the center support portion 14 is co-planar with bottom-most edges of the feet 44 of the support structures 40.

FIG. 6 is an enlarged view of Area A of FIG. 5. When connected, the outer sleeve 20 of the connector 10 extends through the opening 46 in the deck 42 and into the foot 44 of the support structure 40. The body portion 12 abuts the deck 42 of the support structure 40.

Figure 7:
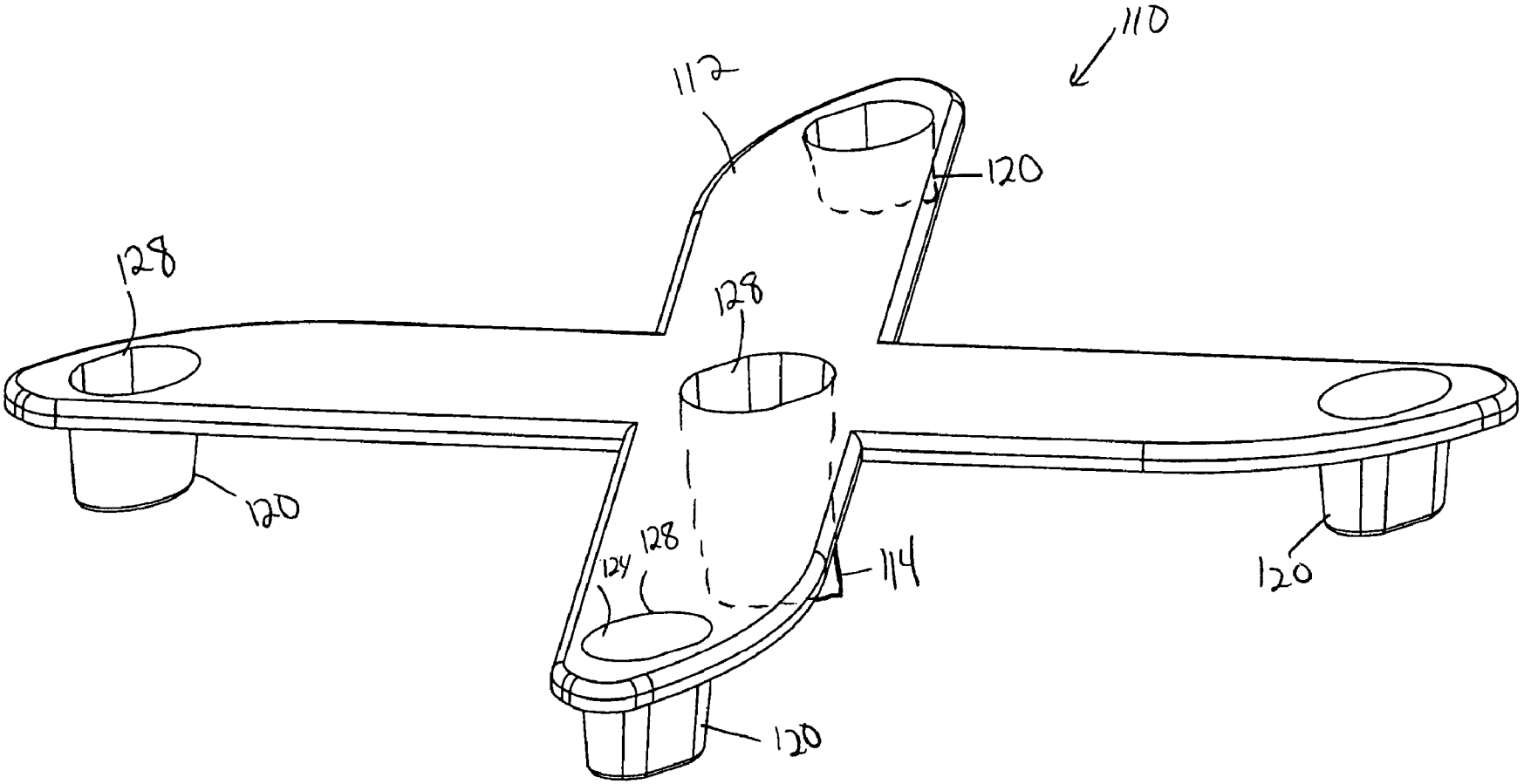
FIG. 7 is a perspective view of a connector according to a second embodiment of the present invention.

FIG. 7 is a perspective view of a connector 110 according to a second embodiment of the present invention. The connector 110 includes an x-shaped body portion 112. A generally cylindrical center support portion 114 extends downward from the intersection of the x-shaped body portion 112. Generally cylindrical outer sleeves 120 extend downward from outer ends of the arms of the x-shaped body portion 112. Openings 128 extend through the body portion 112 and are aligned with the outer sleeves 120 and the center support portion 114.

Figure 8:
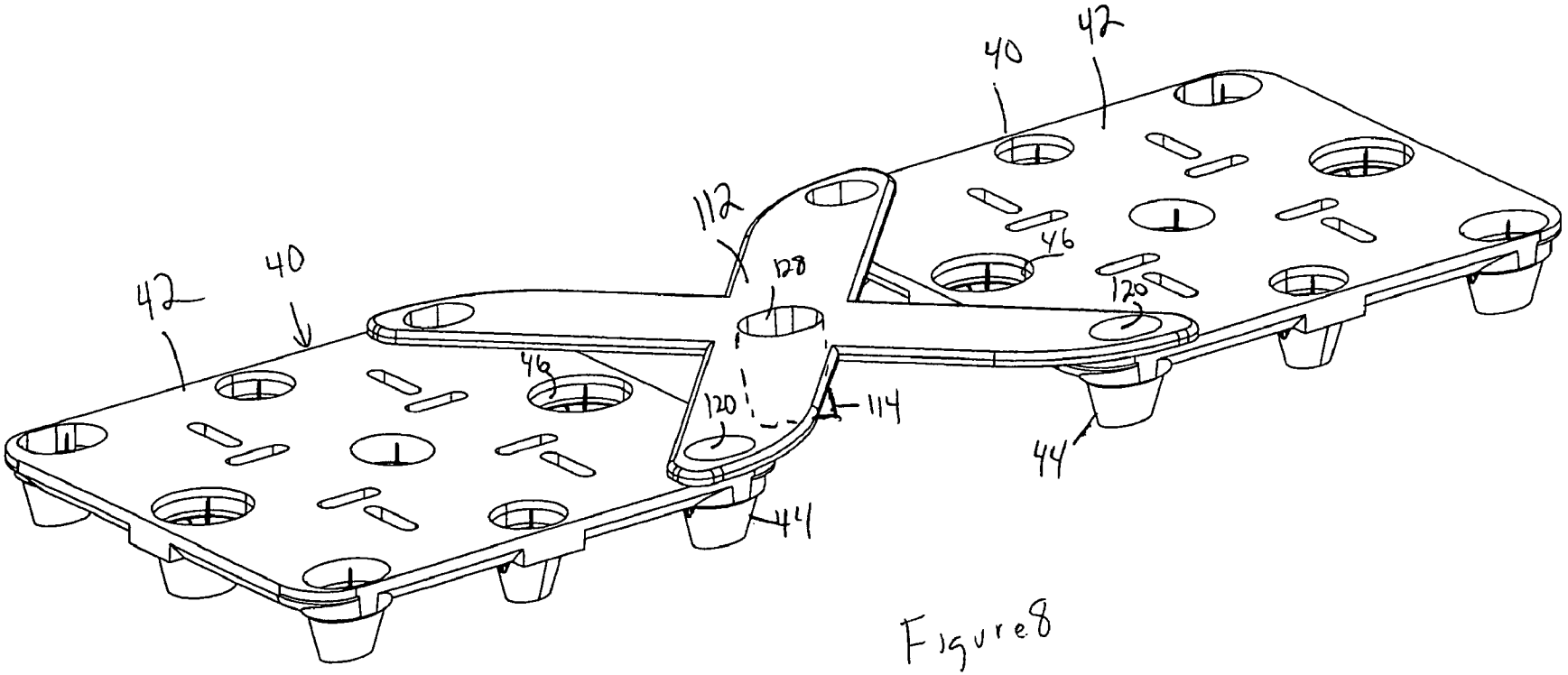
FIG. 8 is a perspective view of the connector of FIG. 7 connecting two support structures.

FIG. 8 is a perspective view of the connector 110 of FIG. 7 connecting two support structures. When connected, the outer sleeves 120 of the connector 110 are received within the openings 46 in the deck 42 of the support structures 40, until the outer sleeves 120 are received within the feet 44 of the support structures 40. In this manner, the connector 110 and the two support structures 40 are connected as a single, large, rigid unit that is suitable for supporting large, non-rigid object (s). When connected, the bottom-most edge of the center support portion 114 is co-planar with the feet 44 of the support structures 40, such as when the support structures 40 and connector 110 are resting on the floor.

Figure 9:
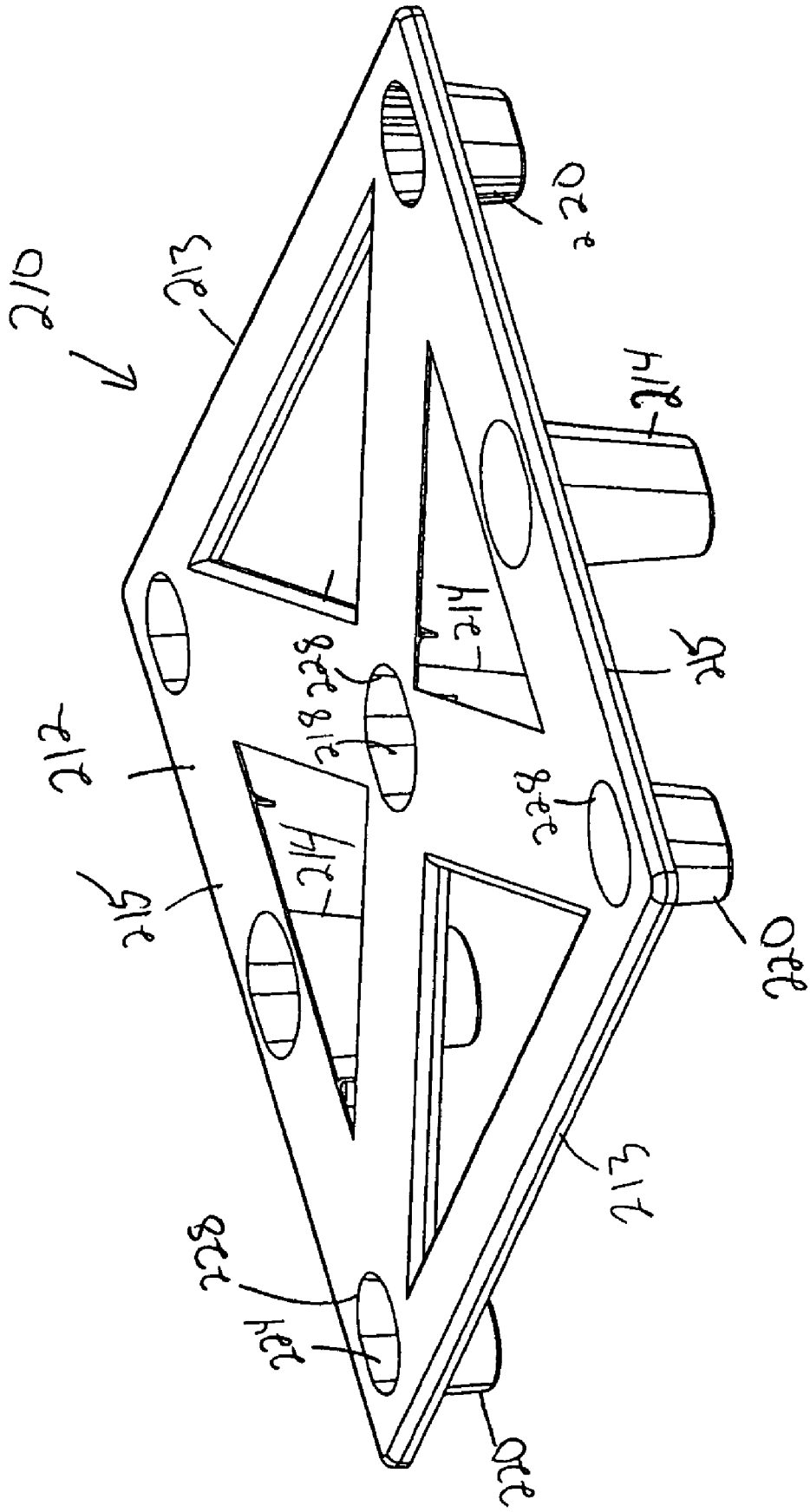
FIG. 9 is a perspective view of a connector according to a third embodiment of the present invention.

FIG. 9 is a perspective view of a connector 210 according to a third embodiment of the present invention. The connector 210 includes an x-shaped body portion 212, elongated side portions 213 and elongated end portions 215 connecting adjacent outer ends of the x-shaped body portion 212. A generally cylindrical center support portion 214 extends downward from the intersection of the x-shaped body portion 212 and from the center of each of the end portions 215. Generally cylindrical outer sleeves 220 extend downward from outer ends of the arms of the x-shaped body portion 212. Openings 228 extend through the body portion 212 and are aligned with the outer sleeves 220 and the center support portion 214.

Figure 10:
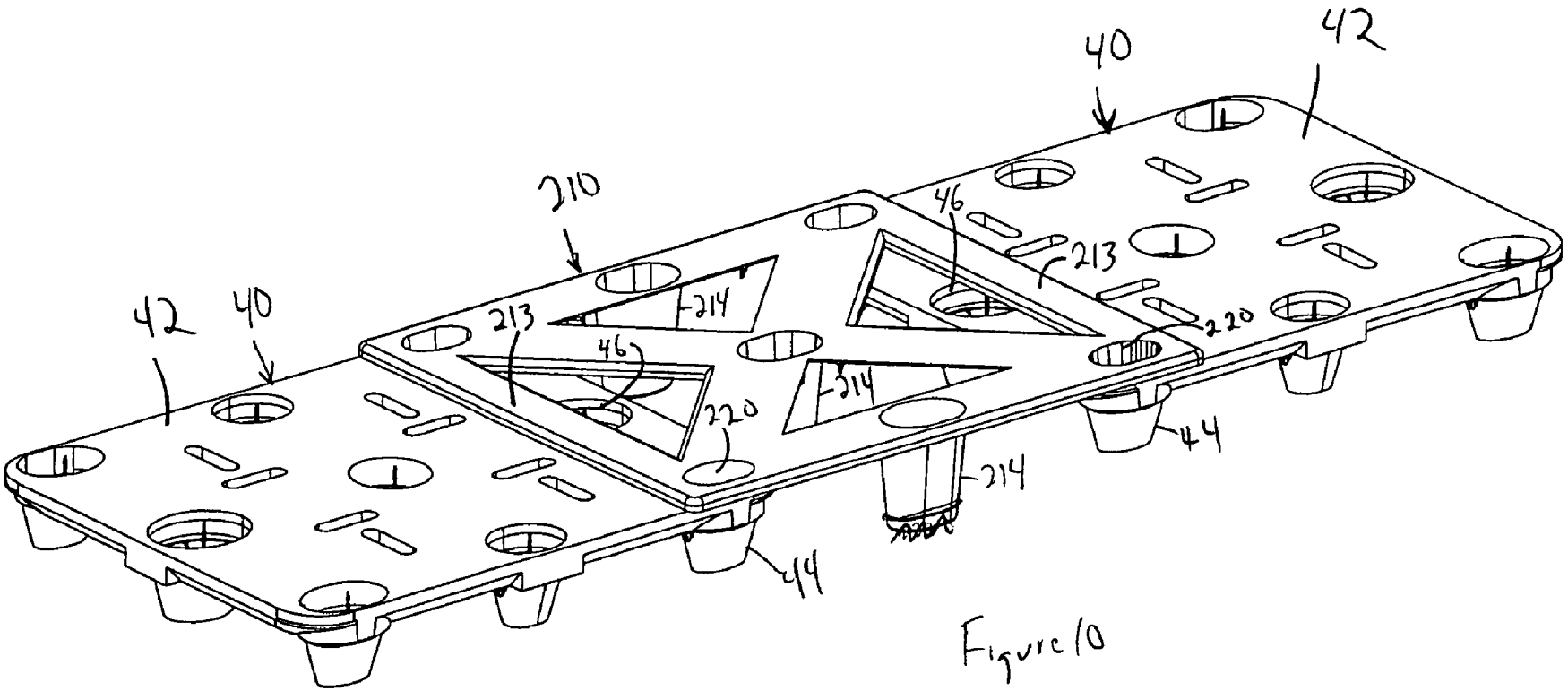
FIG. 10 is a perspective view of the connector of FIG. 9 connecting two support structures.

FIG. 10 is a perspective view of the connector 210 of FIG. 9 connecting two support structures 40. When connected, the outer sleeves 220 of the connector 210 are received within the openings 46 in the deck 42 of the support structures 40, until the outer sleeves 220 are received within the feet 44 of the support structures 40. In this manner, the connector 210 and the two support structures 40 are connected as a single, large, rigid unit that is suitable for supporting large, non-rigid object (s). When connected, the bottom-most edge of the center support portions 214 are co-planar with the feet 44 of the support structures 40, such as when the support structures 40 and connector 210 are resting on the floor. The side portions 213 rest on the decks 42 of the support structures 40.

Figure 11:
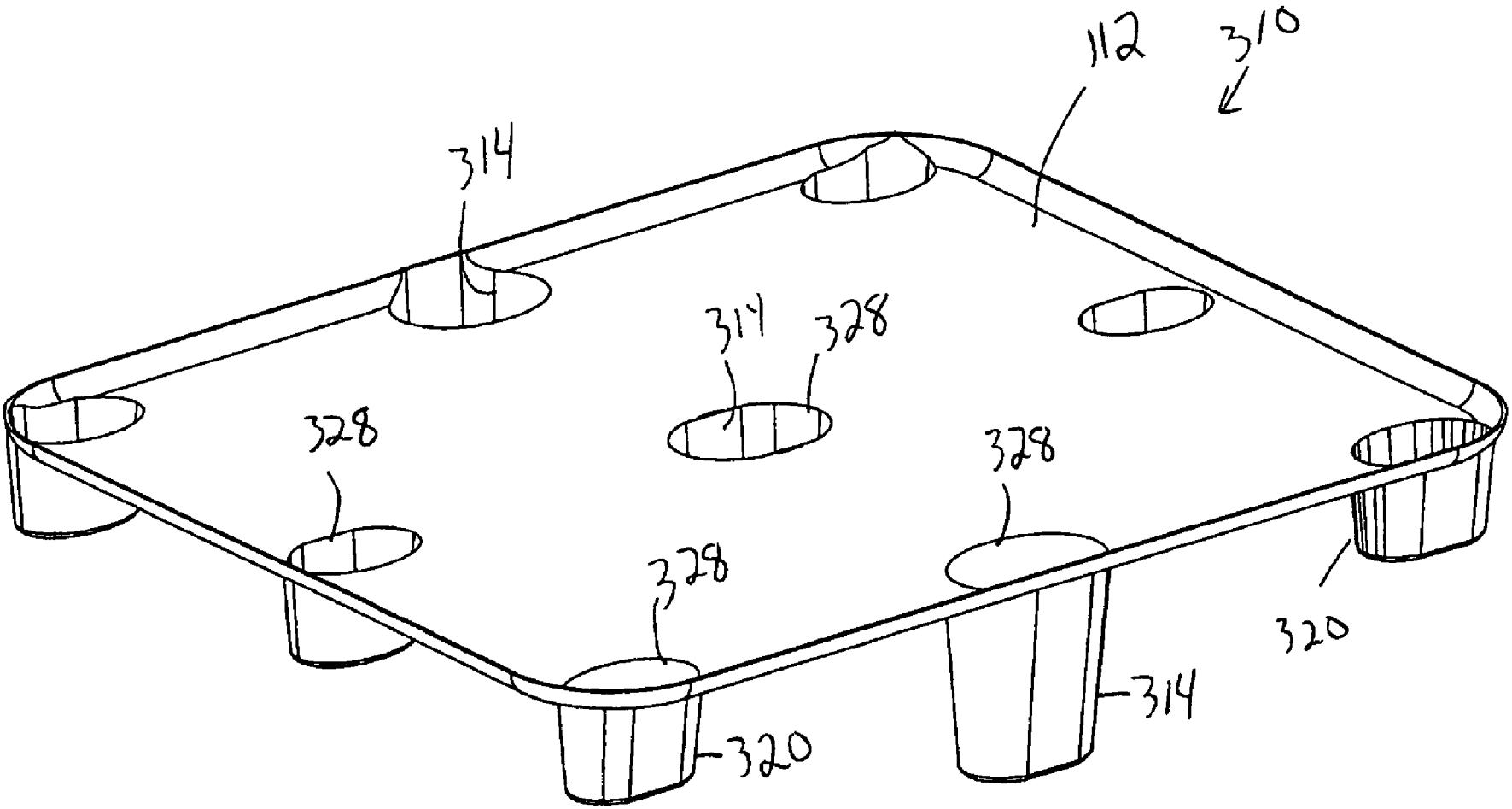
FIG. 11 is a perspective view of a connector according to a fourth embodiment of the present invention.

FIG. 11 is a perspective view of a connector 310 according to a fourth embodiment of the present invention. The connector 310 includes generally planar body portion 312. Three generally cylindrical center support portions 314 extend downward along a centerline of the body portion 312. Three generally cylindrical outer sleeves 320 extend downward from each end of the body portion 312. Openings 328 extend through the body portion 312 and are aligned with the center support portions 314 and outer sleeves 320 and center support portions 314.

Figure 12:
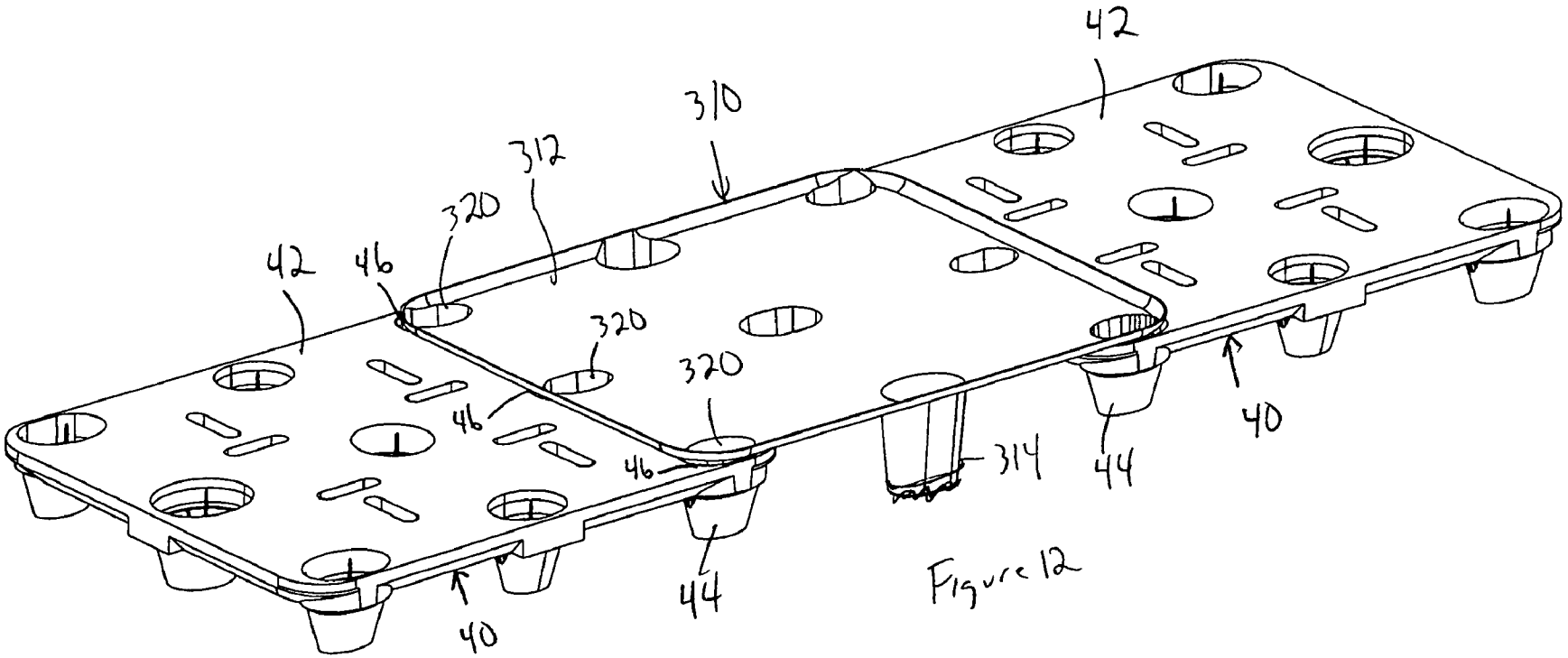
FIG. 12 is a perspective view of the connector of FIG. 11 connecting two support structures.

FIG. 12 is a perspective view of the connector 310 of FIG. 11 connecting two support structures 40. When connected, the outer sleeves 320 of the connector 310 are received within the openings 46 in the deck 42 of the support structures 40, until the outer sleeves 320 are received within the feet 44 of the support structures 40. In this manner, the connector 310 and the two support structures 40 are connected as a single, large, rigid unit that is suitable for supporting large, non-rigid object(s). When connected, the bottom-most edge of the center support portions 314 are co-planar with the feet 44 of the support structures 40, such as when the support structures 40 and connector 310 are resting on the floor, as shown. The body portion 312 of the connector 310 rests on the deck 42 of the support structures 40.

Figure 13:
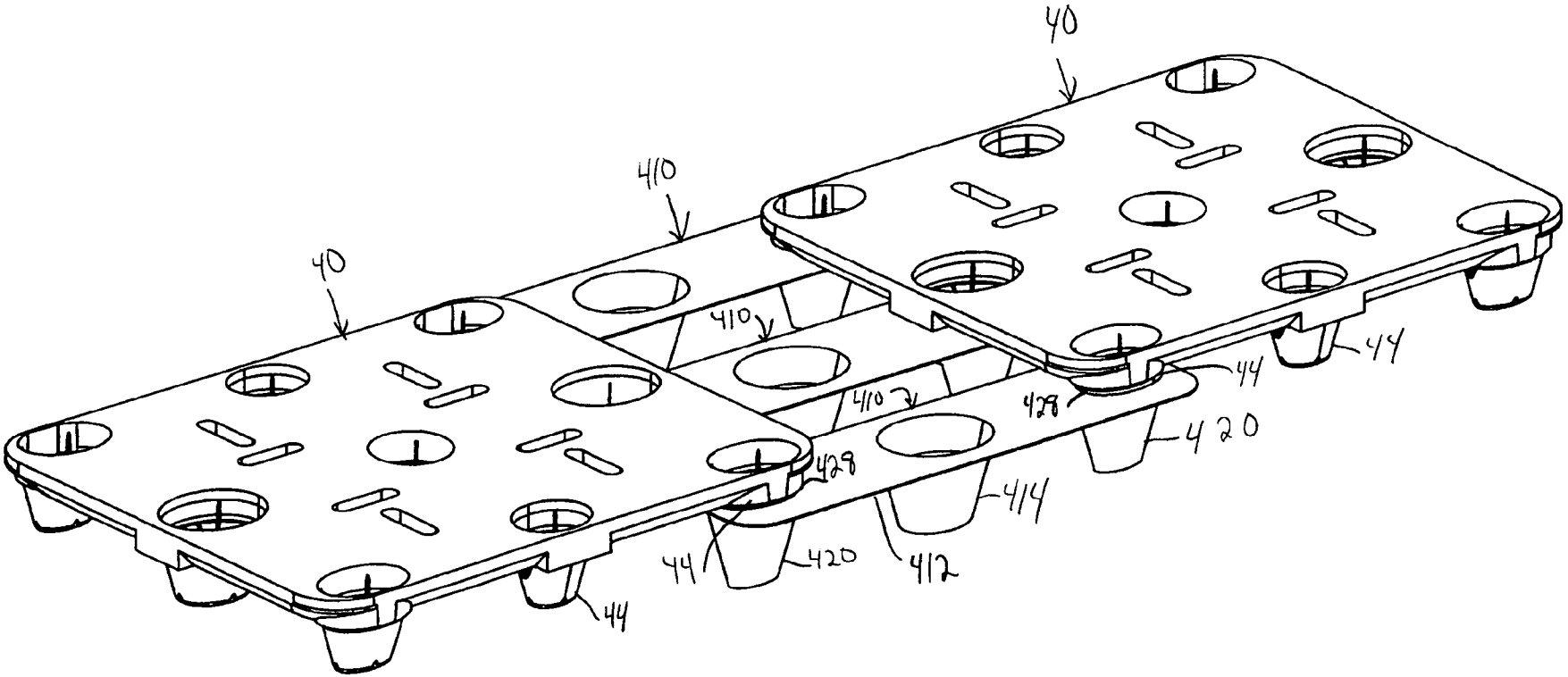
FIG. 13 is a perspective view of three connectors according to a fifth embodiment of the present invention connecting two support structures.

FIG. 13 is a perspective view of three connectors 410 according to a fifth embodiment of the present invention connecting two support structures 40. The connector 410 includes an elongated body portion 412 and a center support portion 414. A pair of outer sleeves 420 on either side of the center support portion 414 and at opposite ends of the body portion 412 are aligned with an opening 428 extending through the body portion 412. The connector 410 is nestable with similar connectors 410, such that the outer sleeves 420 and center support portion 414 can be received within the outer sleeves 420 and center support portion 414 of a like connector 410 stacked therebelow.

To connect the two support structures 40, the feet 44 of the support structures 40 are inserted into the outer sleeves 420 of the connectors 410 through the openings 428. The two structures 40 and connectors 410 provide a single, large, rigid support for supporting objects, such as large, non-rigid objects.

Figure 14:
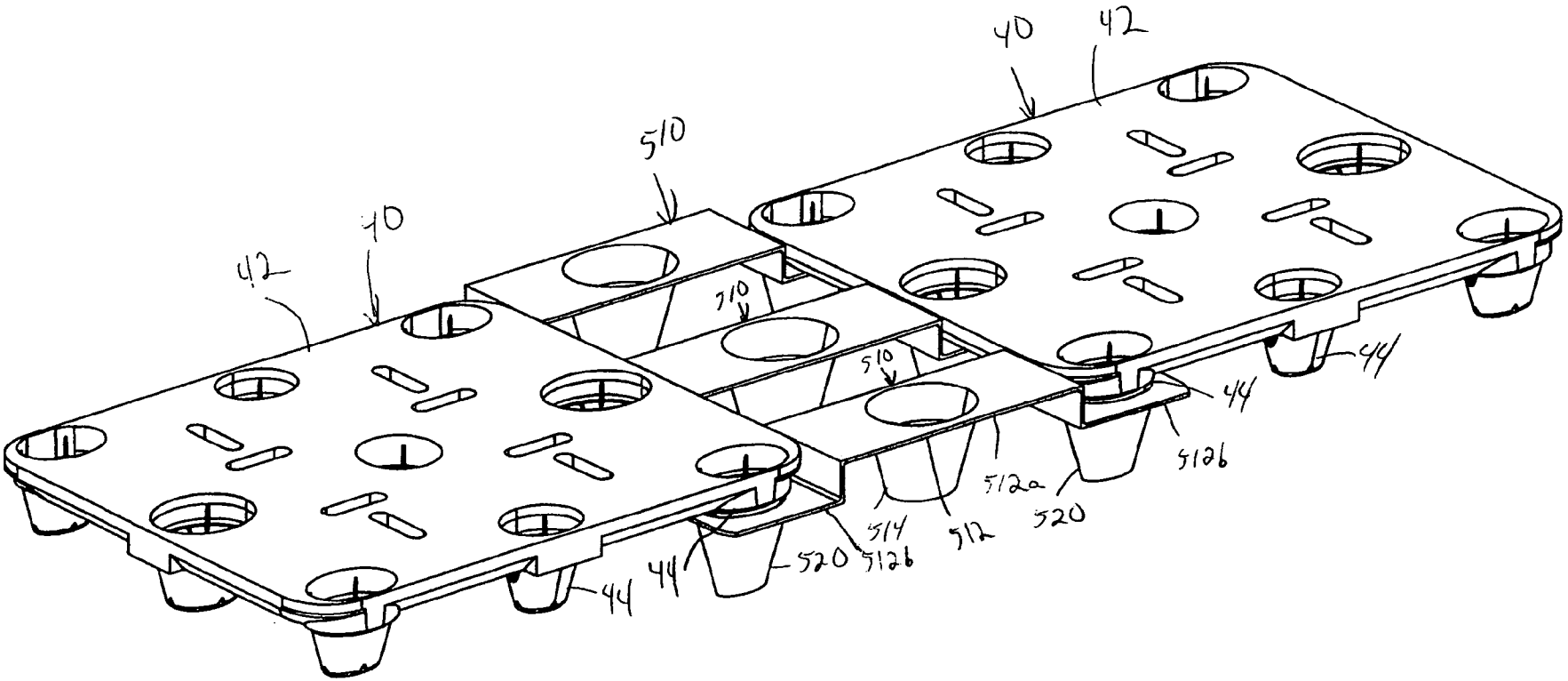
FIG. 14 is a perspective view of three connectors according to a sixth embodiment of the present invention connecting two support structures.

FIG. 14 is a perspective view of three connectors 510 according to a sixth embodiment of the present invention connecting two support structures 40. The connector 510 includes an elongated body portion 512 a center body portion 512*a*, which is elevated relative to two outer body portions 512*b*. A center support portion 514 extends downward from the center body portion 512*a*. A pair of outer sleeves 520 are each aligned with an opening 528 extending through one of the outer body portions 512*b*. The connector 510 is nestable with similar connectors 510, such that the outer sleeves 520 and center support portion 514 can be received within the outer sleeves 520 and center support portion 514 of a like connector 510 stacked therebelow. To connect the two support structures 40, the feet 44 of the support structures 40 are inserted into the outer sleeves 520 of the connectors 510 through the openings 528. The two structures 40 and connectors 510 provide a single, large, rigid support for supporting objects, such as large, non-rigid objects. The elevated center body portion 512*a* provides a continuous surface with the decks 42.

Figure 15:
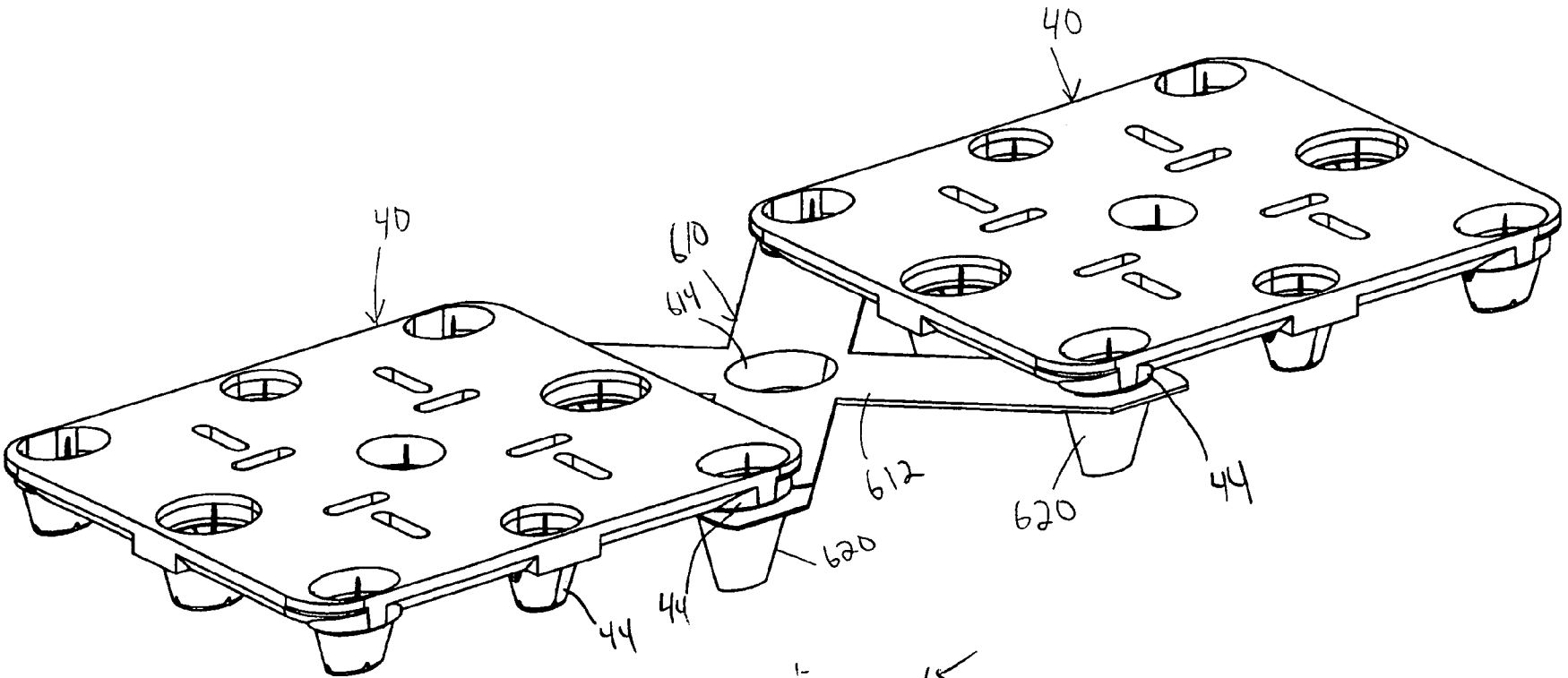
FIG. 15 is a perspective view of a connector according to a seventh embodiment of the present invention connecting two support structures.

FIG. 15 is a perspective view of a connector 610 according to a seventh embodiment of the present invention connecting two support structures. The connector 610 includes an x-shaped body portion 612. A generally cylindrical center support portion 614 extends downward from the intersection of the x-shaped body portion 612. Generally cylindrical outer sleeves 620 extend downward from outer ends of the arms of the x-shaped body portion 612. To connect the two support structures 40, the feet 44 of the support structures 40 are received in the outer sleeves 620 of the connector 610.

Figure 16:
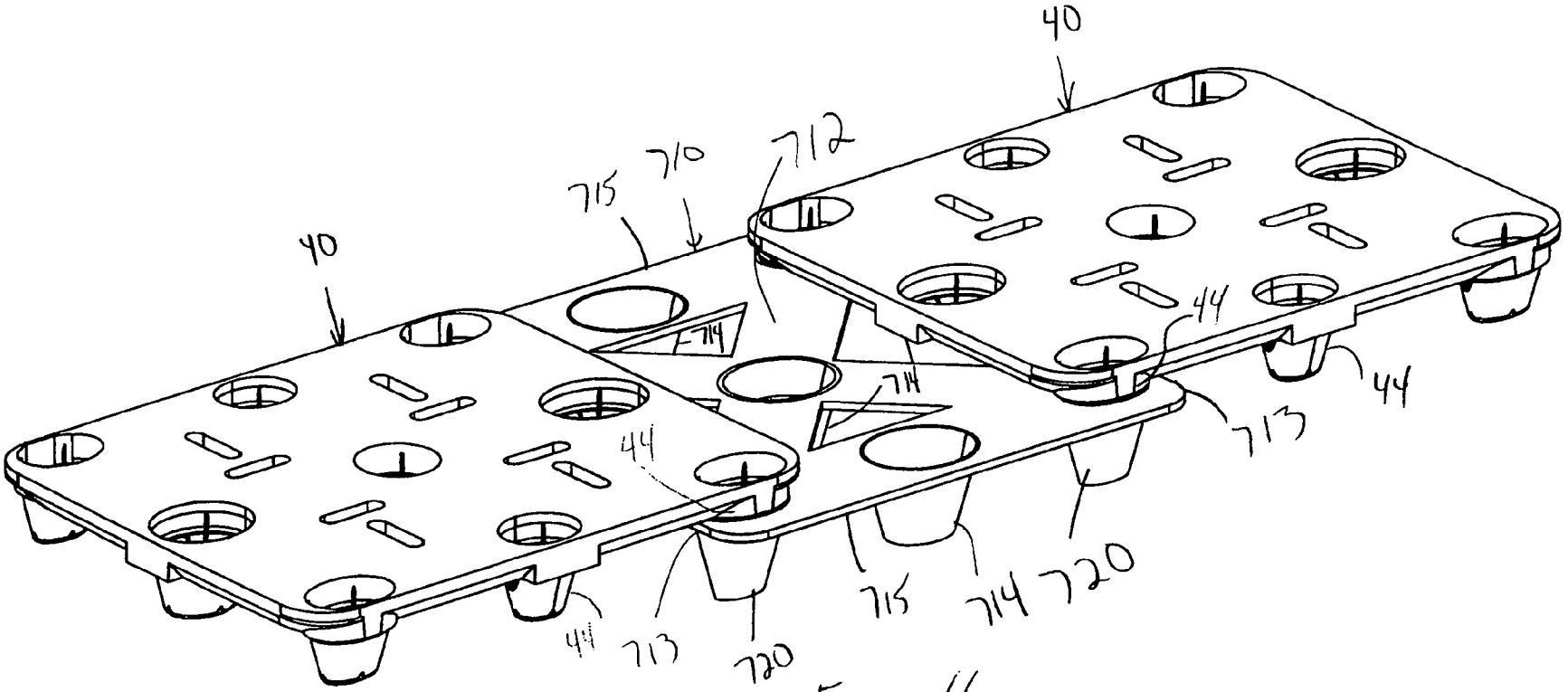
FIG. 16 is a perspective view of a connector according to an eighth embodiment of the present invention connecting two support structures.

FIG. 16 is a perspective view of a connector 710 according to an eighth embodiment of the present invention connecting two support structures 40. The connector 710 includes an x-shaped body portion 712, elongated side portions 713 and elongated end portions 715 connecting adjacent outer ends of the x-shaped body portion 712. A generally cylindrical center support portion 714 extends downward from the intersection of the x-shaped body portion 712 and from the center of each of the end portions 715. Generally cylindrical outer sleeves 720 extend downward from outer ends of the arms of the x-shaped body portion 712. The feet 44 of the support structures 40 are received in the sleeves 720 of the connector 710 to connect the support structures 40.

Figure 17:
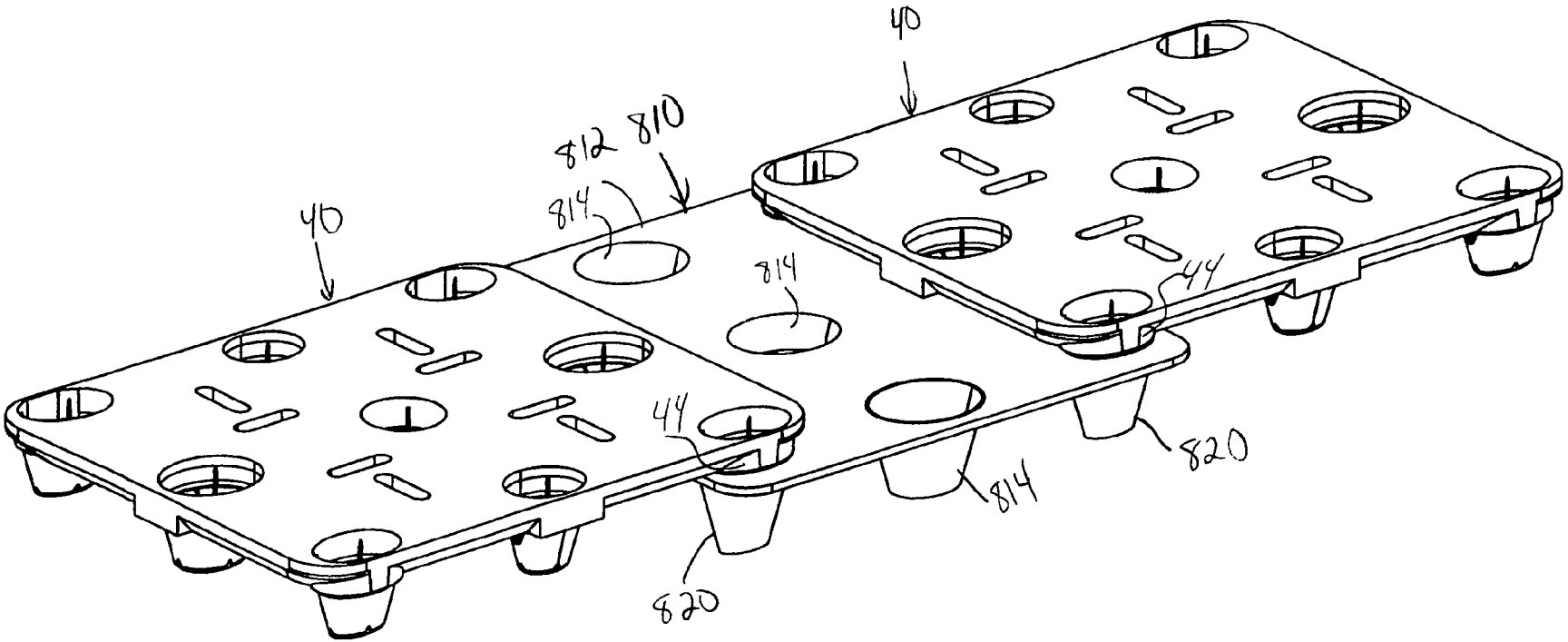
FIG. 17 is a perspective view of a connector according to a ninth embodiment of the present invention connecting two support structures.

FIG. 17 is a perspective view of a connector 810 according to a ninth embodiment of the present invention connecting two support structures 40. The connector 810 includes generally planar body portion 812. Three generally cylindrical center support portions 814 extend downward along a centerline of the body portion 812. Three generally cylindrical outer sleeves 820 extend downward from each end of the body portion 812. The feet 44 are received in the outer sleeves 820 of the connector 810 to connect the two support structures 40.

Figure 19:
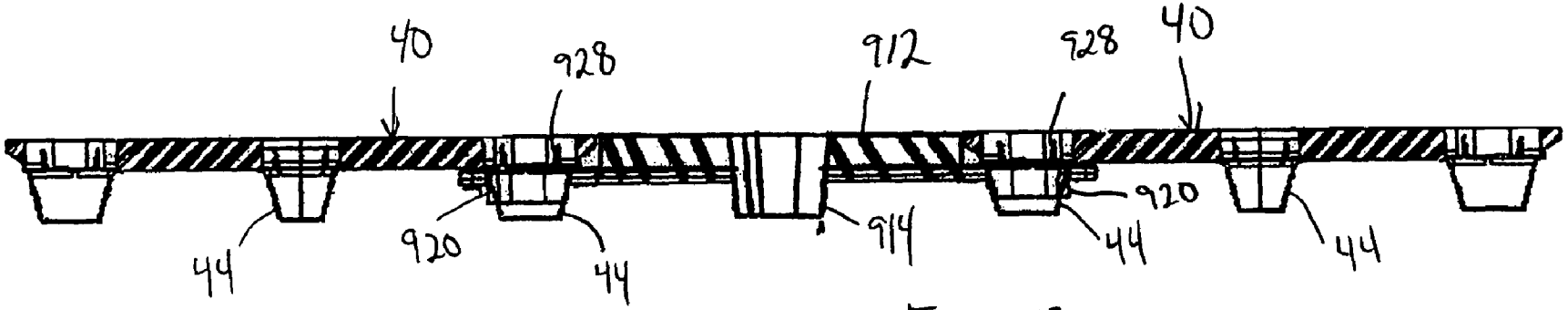
FIG. 19 is a sectional view through the connector of FIG. 18 connecting two support structures.
Figure 18:
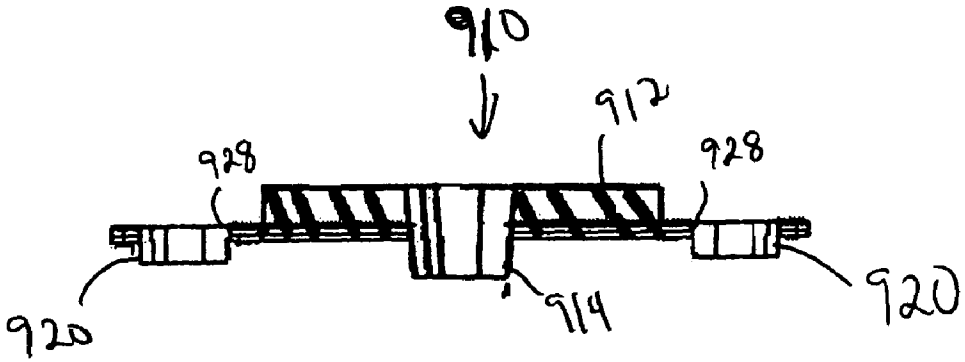
FIG. 18 is a sectional view through a connector according to a tenth embodiment of the present invention.

FIG. 18 is a sectional view through a connector 910 according to a tenth embodiment of the present invention. The connector 910 could be a 1×3 connector similar to those in FIGS. 1, 13 and 14 or a 3×3 connector as shown in the other embodiments. The connector 910 includes a body portion 912 from which a center support portion 914 and outer sleeves 920 extend downwardly. The outer sleeves 920 define openings 928 through the connector 910. In this embodiment the outer sleeves 920 do not extend to the floor, but are open at the bottom so that the feet 44 of the support structures 40 can extend through them to the floor, as shown in FIG. 19.

Figure 20:
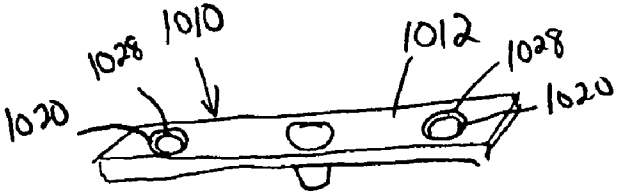
FIG. 20 is a perspective view of a connector according to an eleventh embodiment of the present invention.

The outer sleeves 1020 could also simply be the openings 1028 through the body portion 1012, as shown in an eleventh embodiment of the present invention in FIG. 20.

The connector 10 to 1010 of the present invention could be made of polypropylene, HDPE, polycarbonate or any other suitable material, such as via an injection-molding or any other suitable process. All of the embodiments are nestable.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, several possible shapes of the body portion 12 to 1012 are shown, but other shapes of the body portion could also be used. Also, the connector 10 to 1010 has been shown connecting two standard-size full pallets that each have nine feet arranged three by three, but could also be used with non-standard two by three or one by three pallets. It could also be used to connect support structures of different size, shape, configuration, numbers of feet and aspect ratios. The connector could connect non-standard size pallets or non-standard size support structures.

What is claimed is:

1. A connector connecting at least two support structures, the connector comprising a body portion, a center support portion extending a first distance downwardly from the body portion, and outer sleeves extending downwardly from the body portion on opposite sides of the center support portion, each outer sleeve extending downwardly less than the center support portion; and at least two support structures, each support structure including at least one foot portion having a nesting recess therein, wherein the outer sleeves of the connector are each received within the nesting recess of a different one of the two support structures, wherein at least one of the support structures is a pallet.

2. The connector and support structures of claim 1 wherein the at least one of the support structures includes a deck from which extends the at least one foot portion, the deck including an opening aligned with the nesting recess of the at least one foot portion, one of the outer sleeves of the connector received within the opening in the deck and the nesting recess.

3. A connector for connecting at least two support structures comprising:

a body having an upper surface;

a support extending downwardly from the body;

a first sleeve extending downwardly from a first end of the body and having a bottom-most edge at a first distance from the upper surface of the body, the support having a bottom-most edge at a second distance from the upper surface of the body, the first distance being less than the second distance;

a second sleeve extending downwardly from a second end of the body, the second end opposite the first end, wherein the support, the first sleeve and the second sleeve are nestable with a support, first sleeve and second sleeve of a similar connector;

wherein the connector is connected to two support structures, each support structure including at least one foot portion having a nesting recess therein, wherein the first and second sleeves of the connector are each received within the nesting recess of a different one of the two support structures; and wherein at least one of the support structures is a pallet.

4. The connector of claim 3 wherein the upper surface of the body supports objects thereon, the first sleeve has a bottom-most edge at a first distance from the upper surface of the body and the support has a bottom-most edge at a second distance from the upper surface of the body, the first distance being less than the second distance.

5. The connector of claim 4 wherein the second sleeve has a bottom-most edge at the first distance from the upper surface of the body.

6. The connector of claim 5 wherein the support is taller than the first sleeve.

7. The connector and support structures of claim 3 wherein a bottom-most edge of the at least one foot portion of each of the two support structures, and the bottom-most edge of the support, define a plane.

8. The connector and support structures of claim 7 wherein the at least one of the support structures includes a deck from which extends the at least one foot portion, the deck including an opening aligned with the nesting recess of the at least one foot portion, one of the first and second sleeves of the connector received within the opening in the deck and the nesting recess.

9. The connector of claim 3 connected to two support structures, each support structure including a plurality of foot portions each having a nesting recess therein, wherein the foot portions are at least partially nestable within the nesting recesses of a like support structure, and wherein the first and second sleeves of the connector are each received within the nesting recess of a different one of the two support structures.

* * * * *